United States Patent [19]

Wyman et al.

[11] Patent Number: 4,829,897

[45] Date of Patent: May 16, 1989

[54] AUTOMATIC CLEANER FOR OFFSET PRINTING BLANKET

[75] Inventors: Donald P. Wyman; Grant B. Matta, both of Fairport; William A. Beattie, Spencerport, all of N.Y.

[73] Assignee: Printex Products Corporation, Rochester, N.Y.

[21] Appl. No.: 215,346

[22] Filed: Jul. 5, 1988

[51] Int. Cl.[4] ..... B41F 35/00

[52] U.S. Cl. ..... 101/483; 101/424; 101/425; 134/15; 134/40; 252/537

[58] Field of Search ..... 101/424, 425, 483; 134/15, 38–40, 42; 252/535, 537, 173, 174.25, 166, 167

[56] References Cited

U.S. PATENT DOCUMENTS

| | | | |
|---|---|---|---|
| 3,120,805 | 2/1964 | Simon . | |
| 3,373,115 | 3/1968 | Steppan . | |
| 3,592,136 | 7/1971 | Selman . | |
| 3,693,547 | 9/1972 | Morgan . | |
| 3,835,779 | 9/1974 | Ross et al. . | |
| 3,897,726 | 8/1975 | Junghans . | |
| 3,952,654 | 4/1976 | Evans . | |
| 3,983,813 | 10/1976 | Tani . | |
| 4,132,167 | 1/1979 | Ishii . | |
| 4,232,604 | 11/1980 | Waizmann . | |
| 4,344,361 | 8/1982 | MacPhee et al. . | |
| 4,393,778 | 7/1983 | Kaneko . | |
| 4,474,111 | 10/1984 | Holzhauser . | |
| 4,507,155 | 3/1985 | Cheek | 101/424 X |
| 4,686,902 | 8/1987 | Allain et al. . | |

*Primary Examiner*—E. H. Eickholt

*Attorney, Agent, or Firm*—Stonebraker, Shepard & Stephens

[57] ABSTRACT

An improved automatic blanket wash system for offset printing wherein the washing medium is a water-in-oil emulsion containing 5–35 percent by weight water and 65–95 percent by weight of a water insoluble phase that contains certain hydrocarbons in specific proportions and a surfactant having an HLB of 3–11.

27 Claims, No Drawings

AUTOMATIC CLEANER FOR OFFSET PRINTING BLANKET

BACKGROUND

Automatic blanket cleaning systems are preferred for cleaning ink build-up, paper lint, and other debris from the blanket of an offset printing press. Automatic cleaning usually occurs when a splice is passing through a press during a paster cycler that occurs on supply roll changes, and the press does not have to be stopped for automatic cleaning. Cleaning solution is sprayed on the blanket during the splice or paster cycle, and portions of the web preceding and trailing the splice are used to blot up and remove blanket soil. This part of the web is discarded anyway, so that automatic cleaning does not slow down the press or waste any paper.

Although automatic cleaning is much more desirable than manual cleaning, because of speed, efficiency, and safety, automatic cleaning has not yet been perfected; and better cleaning results are still being sought from automatic cleaning systems.

An automatic blanket wash system described in U.S. Pat. No. 4,686,902 uses an aqueous washing emulsion that is intended for use at low concentrations of the water insoluble phase. At higher concentrations that are preferred when printing is done on high quality coated paper, the emulsion is highly viscous and difficult to handle for the rapid cleaning that is required.

Our invention provides a blanket cleaning formula that achieves optimum cleaning rapidly and effectively. Although our cleaning medium can be used to wash the blanket manually, it has been designed and formulated to be dispensed at high concentrations of the water insoluble phase through an automatic blanket washing system. This permits the preferred cleaning "on-the-fly" while the press is operating, to reduce press shutdowns and work stoppages. In doing this, our cleaner uses chemicals that are effective and convenient to handle and that achieve excellent overall cleaning performance. Further, our invention permits cleaning to be accomplished with quantities of cleaning medium that are able to maintain low solvent vapor concentrations in presses equipped with dryers.

SUMMARY OF THE INVENTION

Our invention provides a system and process for cleaning blankets that are used in offset printing, the blankets having become soiled by ink deposits and lint or other solid particles from the web or sheet being printed. The blankets are sprayed with a washing medium, preferably as a finely divided spray, that is a stable water-in-oil emulsion. The emulsion contains 5–35 percent by weight of water and 65–95 percent by weight of a water insoluble or water immiscible phase containing 80–99.5 percent by weight of hydrocarbons, the hydrocarbons being 10–50 percent by weight of $C_6$–$C_{15}$ aromatic hydrocarbons or $C_{10}$–$C_{20}$ terpene hydrocarbons and 50–90 percent by weight of $C_5$–$C_{18}$ aliphatic hydrocarbons. Additionally, the water insoluble phase contains 0.5–20 percent by weight of one or more non-ionic surfactants having an HLB (hydrophilic-lipophilic balance) within the range of 3–11. The water insoluble phase may also contain 0–10 percent by weight of polar solvent to improve the cleaning effectiveness of the washing medium.

DETAILED DESCRIPTION

Our cleaning emulsion for offset printing blankets contains water, the primary purpose of which is to remove web debris rapidly from the blanket. Preferably, only the minimum amount of water that is needed to perform that function is used, and that amount is in the range of 5–35 percent by weight, preferably 10–20 percent by weight. Especially when printing on paper, the water used is kept to a minimum, because water weakens paper, and an excess of water may exceed the wet strength of the paper being run through the press. When printing on newsprint, from 20–35 percent by weight of water may be needed because newsprint causes a relatively large amount of lint and other debris to deposit on the blanket. When printing on better quality papers, such as resin-coated papers, the water that is needed in the washing medium is preferably limited to 10–20 percent by weight.

The washing medium also contains a water insoluble or water immiscible phase. This phase must be carefully prepared so that it is capable of quickly softening the ink deposits that accumulate on the blanket. Selected hydrocarbons in specific proportions are used in this phase so that the ink deposits on the blanket are rapidly penetrated, softened, and removed from the blanket.

The water insoluble phase forms 65–95 percent by weight of the emulsion, and from 80–99.5 percent by weight of the water insoluble phase is made up of carefully selected hydrocarbons that are capable of quickly removing the ink deposits from the blanket. From 10–50 percent by weight of the hydrocarbons are $C_6$–$C_{15}$ aromatic hydrocarbons or $C_{10}$–$C_{20}$ terpene hydrocarbons. Most of the aromatic hydrocarbons e.g. at least 75 percent by weight of the total aromatic hydrocarbons, are $C_9$–$C_{12}$ hydrocarbons. Small amounts of benzene and toluene may be present as well as $C_8$ aromatic hydrocarbons such as xylene, ethylbenzene, styrene, and benzocyclobutane. Also, $C_{13}$–$C_{15}$ aromatic hydrocarbons may be present in amounts of 10 percent by weight or slightly higher. Among the $C_{13}$–$C_{15}$ aromatic hydrocarbons are various alkylbenzenes, alkyl naphthalene, anthracene, phenanthrene, and the like.

Most of the aromatic hydrocarbons that are present are $C_9$–$C_{12}$ hydrocarbons, such as cumene, mesitylene and its isomers, isopropenylbenzene, n-propylbenzene, ethyltoluene, methylstyrene, benzocyclopentane, benzocyclopentene, naphthalene, tetrahydro naphthalene, butylbenzene, butenylbenzene, diethylbenzene, ethylstyrene, methylcumene, durene, methyl n-propylbenzene, $\alpha$- and $\beta$- naphthalene, amylbenzene, butyltoluene, propylethylbenzene, propylstyrene, ethylpropenylbenzene, ethylisopropenylbenzene, pentamethylbenzene, diethyltoluene, methyltetrahydro naphthalene, and the like. Terpenes such as d-limonene, l-limonene, dipentene, $\alpha$-terpinene, isoterpinene, and the like can be used, either mixed with the aromatic hydrocarbons, or in place of the aromatic hydrocarbons.

The hydrocarbons also contain from 50–90 percent by weight of aliphatic hydrocarbons. Most of the aliphatic hydrocarbons, e.g. at least 80 percent by weight, are $C_7$–$C_{14}$ aliphatic hydrocarbons. However, small amounts, e.g. 10 percent by weight or higher, of $C_5$ and $C_6$ aliphatic hydrocarbons and 5 percent by weight or higher of $C_{15}$–$C_{18}$ aliphatic hydrocarbons may be present. The $C_7$–$C_{14}$ aliphatic hydrocarbons in the linear, branched, and alicyclic forms are the predominant aliphatic hydrocarbons.

The water insoluble phase may contain small amounts, e.g. not substantially more than 10 percent by weight, of non-terpene olefinic hydrocarbons, replacing an equal amount of aromatic, terpene, or aliphatic hydrocarbon, but olefinic hydrocarbons are not essential.

An important and essential component of the washing medium is the surfactant, which must be carefully selected so that the emulsion will be water-in-oil and will have a viscosity that is low enough to be readily pumped through the delivery system, especially when only relatively small amounts of water are needed in the washing medium. The surfactant must also provide stability to the emulsion, to minimize phase separation. The minimum amount of surfactant that provides the essential properties to the emulsion is used, and the amount of surfactant is within the range of 0.5–20 percent by weight of the water insoluble phase and preferably 4–10 percent by weight.

The HLB (hydrophilic-lipophilic balance) is a well-established concept for classifying surface active agents. A commonly used formula for non-ionic surfactants is:

$$HLB = \frac{20 \times M_H}{M_H + M_L}$$

where $M_H$=molecular weight of the hydrophilic portion of the molecule and $M_L$=the molecular weight of the lipophilic (hydrophobic) segment. For example, for $$C_9H_{19}C_6H_4—O—(CH_2—CH_2—O)—_4H$$

$M_H$=molecular weight of 4x(—$CH_2CH_2$—O—)=176

$M_L$=molecular weight of $C_9H_{14}C_6H_4OH$=220

$$HLB = \frac{20 \times 176}{176 + 200} = 8.9$$

The higher the HLB, the more water soluble the surfactant, i.e., the more hydrophilic. When multiple non-ionic surfactants are used in our cleaning emulsions, the HLB of the mixture of surfactants is the average of the HLB's of the individual surfactants. The surfactants that provide the essential properties to the washing medium of this invention have an HLB of 3–11. Suitable surfactants can be found in *McCutcheon's Index*. A preferred surfactant is nonylphenol-4-ethoxylate having an HLB of 8.9.

The water insoluble phase may also contain some polar solvents in an amount not substantially above 10 percent by volume. Suitable polar solvents are the glycol ethers and the higher molecular weight alcohols. Propylene glycol, amyl acetate, hexylene glycol, methylene chloride, 1,1,1-trichloroethane, n-octyl alcohol, diethylene glycol monobutyl ether, ethylene glycol monobutyl ether, and other glycol ethers can be used.

The washing medium of this invention can be used to clean any type of offset printing press blanket. It is effective when used to clean a sheet-fed press blanket, but it is even more advantageous when used to clean a web-fed press blanket. When a web-fed press is to be cleaned, it is preferred to spray the washing medium or cleaning emulsion in a finely divided, droplet form onto the blanket to be cleaned, immediately after the nip or contact point between the roll containing the inked lithographic plate and the roll containing the blanket, although the emulsion can be sprayed onto the blanket roll at other locations. The rolls revolve in opposite directions, i.e. the plate roll revolves counterclockwise and the blanket roll revolves clockwise. The cleaning emulsion penetrates the soil on the blanket, softens it, and loosens the bond between the soil and blanket surface; and when the web contacts the blanket, it picks up the soil.

This cleaning procedure can be used at any time during the operation of the press, with minimum interruption of operation. The press speed is usually not reduced and ink forms need not be lifted. The short spray time per roll and the maintenance of registration dramatically reduce the number of lost signatures or waste. Cleaning can be accomplished at intervals of 20–45 minutes, and it is especially efficient when the cleaning is coordinated with a flying splice of the web. The cleaning emulsion is sprayed onto the blanket as a splice passes through the press, and the web ahead of and behind the splice picks up soil from the blanket when the web contacts the blanket. Printing continues with a cleaned blanket, and the web in the region of the splice is subsequently discarded, as it would be even if cleaning had not been performed.

The spraying of emulsion onto the blanket can be accomplished by having a spray bar positioned near to, but not in contact with, the blanket roll. The number of nozzles in the spray bar depends on the width of the blanket that is being cleaned. The amount of emulsion that is sprayed onto the blanket depends on the amount and depth of soil on the blanket. In actual operation, the amount of emulsion that is used can be controlled by the length of spray time, which typically may vary from 0.5 to 1.0 second per blanket. The use of too much emulsion should be avoided to prevent accumulation of hydrocarbon solvent, particularly when the printed web passes through a drying unit. In such cases, the ability to control solvent quantities in an automatic operation is much better than in manual cleaning operations.

EXAMPLE 1

A water insoluble phase is prepared by mixing 85 parts by weight Varsol 1 from Exxon (mineral spirits), 9 parts by weight Aromatic 150 from Exxon (aromatic hydrocarbons), and 6 parts by weight of nonylphenol-4-ethoxylate as surfactant. The mixture has the following composition:

| | Percent by Weight |
|---|---|
| C8–C12 aromatic hydrocarbons | 21.9 |
| C9–C12 aliphatic hydrocarbons | 71.3 |
| C9–C12 olefins | 0.8 |
| surfactant | 6.0 |

When 95 to 80 parts of the above composition are emulsified with 5 to 20 parts by weight of water, water-in-oil emulsions are formed and those emulsions are excellent for spray cleaning blankets in web-fed lithographic presses while the presses are in operation.

Surfactants for these cleaners must be able to provide water-in-oil emulsions that are stable with only mild agitation (if needed). They must also significantly increase the overall cleaning performance of the solvent/water mixture. The emulsions must exhibit low viscosity, preferably less than 30 cps, to facilitate pumping and spraying. The surfactants must not adversely affect printing plate chemistry and/or performance. Some offset plates are "blinded" by cationic surfactants.

Therefore, non-ionic surfactants are used. The following examples demonstrate the usefulness of a variety of non-ionic surfactants, either alone or in mixtures, that can be used in these cleaning emulsions.

EXAMPLES 2–13

The following water-in-oil cleaning emulsions were prepared as in Example 1.

TABLE 1

| Example | Surfactant | Ref. | HLB | Wt. % | Wt. % Varsol 1 | Wt. % Aromatic 150 | Cleaner/water (v/v) | Viscosity (cps) |
|---|---|---|---|---|---|---|---|---|
| 2 | Triton X-15 | (1) | 3.6 | 6 | 74.0 | 20.0 | 90/10 | 4.0 |
| | | | | | | | 80/20 | 4.0 |
| 3 | CRILL 6 | (2) | 4.7 | 6 | 74.0 | 20.0 | 90/10 | 4.0 |
| | | | | | | | 80/20 | 4.0 |
| 4 | Triton X-15 | (1) | 3.6 | 2 | 77.7 | 16.3 | 90/10 | 4.0 |
| | Pluronic L-31 | (3) | 5.0 | 2 | | | 80/20 | 4.0 |
| | Igepal CO-430 | (4) | 8.9 | 2 | | | | |
| | | | av. 5.8 | | | | | |
| 5 | Triton X-15 | (1) | 3.6 | 3 | 64.0 | 30.0 | 90/10 | 5.0 |
| | Pluronic L-42 | (5) | 8.0 | 3 | | | 80/20 | 5.0 |
| | | | av. 5.8 | | | | | |
| 6 | Triton X-15 | (1) | 3.6 | 3 | 79.5 | 14.5 | 90/10 | 4.0 |
| | Igepal CO-430 | (4) | 8.9 | 3 | | | 80/20 | 4.0 |
| | | | av. 6.3 | | | | | |
| 7 | Triton X-15 | (1) | 3.6 | 2 | 67.3 | 26.7 | 90/10 | 4.5 |
| | Pluronic L-31 | (3) | 5.0 | 2 | | | 80/20 | 4.5 |
| | Siponic 260 | (6) | 10.7 | 2 | | | | |
| | | | av. 6.4 | | | | | |
| 8 | CRILL 6 | (2) | 4.7 | 3 | 79.5 | 14.5 | 90/10 | 4.5 |
| | Igepal CO-430 | (4) | 8.9 | 3 | | | 80/20 | 4.5 |
| | | | av. 6.8 | | | | | |
| 9 | Pluronic L-31 | (3) | 5.0 | 3 | 79.5 | 14.5 | 80/20 | 6.0 |
| | Igepal CO-430 | (4) | 8.9 | 3 | | | | |
| | | | av. 6.9 | | | | | |
| 10 | Pluronic L-62 | (7) | 8.0 | 3 | 71.5 | 24.5 | 90/10 | 5.0 |
| | Igepal CO-430 | (4) | 8.9 | 3 | | | 80/20 | 5.0 |
| | | | av. 8.5 | | | | | |
| 11 | Igepal CO-430 | (4) | 8.9 | 6 | 85.0 | 9.0 | 90/10 | 4.0 |
| | | | | | | | 80/20 | 5.5 |
| 12 | Igepal CA-520 | (8) | 10.0 | 6 | 74.0 | 20.0 | 80/20 | 5.0 |
| 13 | Siponic 260 | (6) | 10.7 | 6 | 54.0 | 40.0 | 90/10 | 4.0 |
| | | | | | | | 80/20 | 5.0 |

(1) Triton X-15 is the Rohm and Haas name for $C_8H_{17}—C_6H_4—O—CH_2—CH_2—O—H$.
(2) CRILL 6 is manufactured by Croda and is Sorbitan monoisostearate.
(3) Pluronic L-31 is manufactured by BASF Wyandotte. It is a block copolymer of ethylene oxide and propylene oxide of the form (EO)x(PO)y(EO)x and has a molecular weight of 1100.
(4) Igepal CO-430 is the GAF name for ethoxylated nonylphenol $C_9H_{19}—C_6H_4—O—(CH_2—CH_2—O—)_nH$ with n = 4.
(5) Pluronic L-42 is a modification of L-31 (note 3) with a molecular weight of 1630.
(6) Siponic 260 is manufactured by Alcolac and is $C_{12}H_{25}S(CH_2—CH_2—O—)_nH$.
(7) Pluronic L-62 is a modification of L-31 and L-42 (notes 3 and 5) with molecular weight 2500.
(8) Igepal CA-520 is manufactured by GAF and is $C_8H_{17}—C_6H_4—O—(CH_2—CH_2—O—)_5H$.

EXAMPLES 14–21

Table 2 includes compatible polar solvents that can be used in the solvent/surfactant water-in-oil emulsions of this invention.

TABLE 2

| Example | Solvent | Vol. %(1) | Viscosity *(cps) | Emulsion Stable* |
|---|---|---|---|---|
| 14 | Ethylene glycol monobutyl ether | 5 | 3.5 | yes |
| 15 | Diethylene glycol monobutyl ether | 5 | 3.5 | yes |
| 16 | n-octyl alcohol | 5 | 3.5 | yes |
| 17 | 1,1,1-trichloroethane | 5 | 3.5 | yes |
| 18 | Methylene chloride | 5 | 3.5 | yes |
| 19 | Hexylene glycol | 5 | 3.5 | yes |
| 20 | Amyl acetate | 5 | 3.5 | yes |
| 21 | Propylene glycol | 5 | 3.5 | yes |

(1)5% of the indicated solvent plus 95% of Varsol 1/Aromatic 150/Igepal CO-430 (6/85/9) (w/w/w).
*90/10 (v/v) solvent/water emulsion U.S. Pat. No. 4,686,902 describes an automatic blanket wash system, and in column 2 it discloses that an aqueous emulsion called TEX 300 can be used in the wash system. TEX 300 is a water insoluble mixture containing:

| Components | Percent by Weight |
|---|---|
| Varsol 1 | 79 |
| Aromatic 150 | 9 |
| Butyl carbitol | 6 |
| Propylene glycol | 2 |
| Igepal CO-530(1) | 2 |
| Tergitol 24-L-50(2) | 2 |

(1)Igepal CO-530 is $C_9H_{19}—C_6H_4—O—(CH_2—CH_2—O—)_6H$, HLB = 10.8.
(2)Tergitol 24-L-50 is $C_9H_{19}—(CH_2—CH_2—O—)_7H$, HLB = 12.4.

The surfactants in the above composition have an HLB of 11.6. The composition was designed to form oil-in-water emulsions with large amounts of water, e.g. at least 35 percent by weight and preferably 50 percent by weight of water. When less than 50 percent by weight of water is used in an emulsion with TEX 300, the viscosity of the emulsion rises rapidly, making the emulsion difficult to pump and to use as a cleaning medium. The following table provides a comparison of the viscosity changes that occur when TEX 300 and the preferred water insoluble composition of this invention are emulsified with varying amounts of water.

| Weight Percent Water - Insoluble Phase | Viscosity (CPS at 70° F.) | |
|---|---|---|
| | TEX 300 | This Invention |
| 50 | 12 | 20.0 |
| 60 | 35 | 9.0 |
| 70 | 105 | 6.5 |
| 80 | 820 | 5.5 |
| 90 | >1000 | 4.0 |

It is evident from the above table that the emulsions of this invention can contain much higher concentrations of hydrocarbon solvent than TEX 300, while keeping a manageably low viscosity necessary for effective spray cleaning. This not only makes the emulsions of this invention more effective as cleaning media, but also makes them more easily pumped and used in a cleaning system, than TEX 300.

Good oil-in-water emulsions can also be prepared by varying the surfactant in TEX 300. For example, Igepal CO-530 can be removed and only Tergitol 24-L-50 used as the surfactant, or Igepal CO-630 ($C_9H_{19}$—$C_6H_4$—O—($CH_2$—$CH_2$—O—)$_{HLB=13}$) can be used in place of Igepal CO-530. The emulsions become highly viscous and difficult to pump as the amount of water insoluble phase of the emulsion is increased above 50 percent by weight.

EXAMPLE 22

A water insoluble phase is prepared by mixing 85 parts by weight Varsol 1 from Exxon (mineral spirits), 9 parts by weight d-limonene, and 6 parts by weight nonylphenol-4-ethoxylate.

When 90 parts by weight of the above composition are emulsified with 10 parts by weight of water, a stable emulsion having a viscosity of 3.5 cps at 70° F. is formed. When 80 parts are emulsified with 20 parts of water, a stable emulsion (5 cps at 70° F. viscosity) is formed. The emulsions can be used for spray cleaning blankets in web-fed offset presses while the presses are in operation.

The advantages of this invention include cleaning the blanket with minimal interruption of press runs. The cleaning emulsion, which can be easily handled and pumped using readily available, low cost equipment, removes both ink deposits and web debris from the blanket in a simple cleaning operation. Our cleaner is effective at cleaning high quality, resin-coated papers, and it can accomplish the necessary cleaning without using excessive solvent. It makes automatic blanket cleaning more effective and versatile, to help reduce the hazards and inefficiencies of manual cleaning. The cleaning is sufficiently effective during press operations so that only infrequent slowdowns and stoppages are needed, and this consequently increases throughput and productivity. The chemicals are easy to apply, non-corrosive, and convenient to use; and they achieve excellent overall cleaning performance.

We claim:

1. A process for cleaning a blanket that has been soiled by use in an offset printing process which comprises spraying the blanket with a finely divided water-in-oil emulsion containing 5–35 percent by weight of water and 65–95 percent by weight of a water insoluble phase containing 80–99.5 percent by weight of hydrocarbons, said hydrocarbons being 10–50 percent by weight of hydrocarbons selected from the group consisting of $C_6$–$C_{15}$ aromatic hydrocarbons or $C_{10}$–$C_{20}$ terpene hydrocarbons and 50–90 percent by weight of $C_5$–$C_{18}$ aliphatic hydrocarbons, and said water insoluble phase containing 0.5–20 percent by weight of a surfactant selected from the group consisting of non-ionic surfactants and non-ionic surfactant mixtures having an HLB (hydrophilic-lipophilic balance) within the range of 3–11.

2. A process according to claim 1 wherein the viscosity of the emulsion is not in excess of 30 cps at 70° F.

3. In an offset web printing process that employs a lithographic printing plate, a blanket, and a web and wherein the blanket becomes soiled by ink deposits and debris from the web, the improvement which comprises cleaning the blanket by spraying said blanket with a finely divided water-in-oil emulsion containing 5–35 percent by weight of water and 65–95 percent by weight of a water insoluble phase containing 80–99.5 percent by weight of hydrocarbons, said hydrocarbons being 10–50 percent by weight of hydrocarbons selected from the group consisting of $C_6$–$C_{15}$ aromatic hydrocarbons or $C_{10}$–$C_{20}$ terpene hydrocarbons and 50–90 percent by weight $C_5$–$C_{18}$ aliphatic hydrocarbons, and said water insoluble phase containing 0.5–20 percent by weight of a surfactant selected from the group consisting of non-ionic surfactants and non-ionic surfactant mixtures having an HLB (hydrophilic-lipophilic balance) within the range of 3–11.

4. A process according to claim 3 wherein the emulsion contains 5–20 percent by weight water.

5. A process according to claim 3 wherein the aromatic hydrocarbons are $C_9$–$C_{12}$ hydrocarbons and the aliphatic hydrocarbons are $C_7$–$C_{14}$ hydrocarbons.

6. A process according to claim 5 wherein the water insoluble phase contains a polar solvent in an amount not in excess of 10 percent by weight of the water insoluble phase.

7. A process according to claim 5 wherein the amount of surfactant in the water insoluble phase is 4–10 percent by weight of the water insoluble phase.

8. A process according to claim 7 wherein the surfactant is nonylphenol-4-ethoxylate.

9. A process according to claim 7 wherein the surfactant is octylphenoxyethanol.

10. A process according to claim 7 wherein the surfactant is sorbitan monoisostearate.

11. A process according to claim 7 wherein a surfactant mixture of octylphenoxyethanol, a block copolymer of ethylene oxide and propylene oxide (MW about 1100) and nonylphenoxypoly (ethyleneoxy) ethanol is used.

12. A process according to claim 7 wherein a surfactant mixture of octylphenoxyethanol and a block copolymer of ethylene oxide and propylene oxide (MW about 1630) is used.

13. A process according to claim 7 wherein a surfactant mixture of octylphenoxyethanol and nonylphenoxypoly (ethyleneoxy) ethanol is used.

14. A process according to claim 7 wherein a surfactant mixture of sorbitan monoisostearate and nonylphenoxypoly (ethyleneoxy) ethanol is used.

15. A process according to claim 7 wherein a surfactant mixture of a block copolymer of ethylene oxide and propylene oxide (MW about 1100) and nonylphenoxypoly (ethyleneoxy) ethanol is used.

16. A process according to claim 7 wherein a surfactant mixture of a block copolymer of ethylene oxide and propylene oxide (MW about 2500) and nonylphenoxypoly (ethyleneoxy) ethanol is used.

17. A process according to claim 7 wherein the surfactant is nonylphenoxypoly (ethyleneoxy) ethanol.

18. A process according to claim 7 wherein the surfactant is octylphenoxypoly (ethyleneoxy) ethanol.

19. A process according to claim 3 wherein the emulsion is sprayed on the blanket immediately after the contacting of the blanket and the lithographic printing plate.

20. A process according to claim 3 wherein the emulsion is sprayed on the blanket at intervals of 20–45 minutes.

21. A process according to claim 3 wherein the offset web contains a flying splice and wherein the timing of the spraying of the emulsion on the blanket and the entry of the flying splice in the web are coordinated so that the flying splice removes ink deposits and web debris from the blanket.

22. In a blanket wash system for an offset printing press, the improvement which comprises using as a washing medium a stable water-in-oil emulsion containing 5–35 percent by weight of water and 65–95 percent by weight of a water insoluble phase containing 80–99.5 percent by weight of hydrocarbons, said hydrocarbons being 10–50 percent by weight of hydrocarbons selected from the group consisting of $C_6$–$C_{15}$ aromatic hydrocarbons or $C_{10}$–$C_{20}$ terpene hydrocarbons and 50–90 percent by weight $C_5$–$C_{18}$ aliphatic hydrocarbons, and said water insoluble phase containing 0.5–20 percent by weight of a surfactant selected from the group consisting of non-ionic surfactants and non-ionic surfactant mixtures having an HLB (hydrophilic-lipophilic balance) within the range of 3–11.

23. A system according to claim 22 wherein the emulsion contains 5–20 percent by weight water.

24. A system according to claim 22 wherein the aromatic hydrocarbons are $C_9$–$C_{12}$ hydrocarbons and the aliphatic hydrocarbons are $C_7$–$C_{14}$ hydrocarbons.

25. A system according to claim 24 wherein the water insoluble phase contains a polar solvent in an amount not in excess of 10 percent by weight of the water insoluble phase.

26. A system according to claim 24 wherein the amount of surfactant in the water insoluble phase is 4–10 percent by weight of the water insoluble phase.

27. A system according to claim 26 wherein the surfactant is nonylphenol-4-ethoxylate.

* * * * *